US011326833B2

(12) United States Patent
Scalf et al.

(10) Patent No.: US 11,326,833 B2
(45) Date of Patent: May 10, 2022

(54) REFRIGERATOR WITH A SLIDING SHELF

(71) Applicant: Midea Group Co., Ltd., Foshan (CN)

(72) Inventors: Eric Scalf, Louisville, KY (US); Vinayak Naik, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 25 days.

(21) Appl. No.: 16/823,798

(22) Filed: Mar. 19, 2020

(65) Prior Publication Data

US 2021/0293470 A1 Sep. 23, 2021

(51) Int. Cl.

| | |
|---|---|
| ***F25D 25/02*** | (2006.01) |
| ***F25D 11/02*** | (2006.01) |
| ***A47B 57/34*** | (2006.01) |
| ***A47B 96/02*** | (2006.01) |

(52) U.S. Cl.

CPC ..... *F25D 25/024* (2013.01); *A47B 57/34* (2013.01); *A47B 96/024* (2013.01); *A47B 96/025* (2013.01); *F25D 11/02* (2013.01)

(58) Field of Classification Search

CPC ..... A47B 96/025; A47B 96/024; A47B 57/34; F25D 25/024

See application file for complete search history.

(56) References Cited

U.S. PATENT DOCUMENTS 2,527,056 A * 10/1950 Paula ..... A47B 83/045 108/93
3,010,776 A * 11/1961 Fisher ..... F25D 25/02 312/273
3,158,113 A * 11/1964 Johnson ..... A47B 96/025 108/64
4,929,862 A 5/1990 Hamilton et al.
5,090,337 A * 2/1992 Magistrelli ..... B60P 1/00 108/67
5,791,749 A * 8/1998 O'Neill ..... A47F 3/002 312/117
6,802,576 B2 * 10/2004 Shepherd ..... A47F 3/002 312/114
7,182,246 B1 * 2/2007 Sievel ..... A47G 29/22 232/45
7,836,832 B2 * 11/2010 Boyd ..... A47B 3/04 108/40
10,278,502 B2 * 5/2019 Farahani ..... A47B 23/04
2003/0020387 A1 * 1/2003 Wing ..... A47B 96/067 312/408

(Continued)

FOREIGN PATENT DOCUMENTS

DE 102013010077 A1 * 12/2014 ..... F25D 23/069
DE 102013010077 A1 12/2014

(Continued)

OTHER PUBLICATIONS

U.S. Patent and Trademark Office, Office Action issued in U.S. Appl. No. 16/823,799 dated Jul. 6, 2021.

(Continued)

*Primary Examiner* — Kimberley S Wright
(74) *Attorney, Agent, or Firm* — Middleton Reutlinger

(57) ABSTRACT

A refrigerator appliance having one or more sliding shelves. The sliding shelf may slide along one or more tracks. The sliding shelf may include one or more shelf plates. The one or more tracks may be adjustable.

20 Claims, 9 Drawing Sheets

(56) References Cited

U.S. PATENT DOCUMENTS

| | | | | |
|---|---|---|---|---|
| 2008/0190329 | A1* | 8/2008 | Boyd | A47B 5/00 108/39 |
| 2014/0265803 | A1* | 9/2014 | Kelly | F25D 23/00 312/404 |
| 2019/0053641 | A1 | 2/2019 | Morad | |
| 2021/0289938 | A1 | 9/2021 | Scalf et al. | |

FOREIGN PATENT DOCUMENTS

| | | | |
|---|---|---|---|
| EP | 1906122 | B1 | 4/2010 |
| EP | 2336691 | B1 | 5/2012 |
| EP | 3279594 | A1 | 2/2018 |
| KR | 20120129480 | A | 11/2012 |
| KR | 20140088382 | A | 7/2014 |
| WO | WO2018197220 | A1 | 11/2018 |

OTHER PUBLICATIONS

U.S. Patent and Trademark Office, Office Action issued in U.S. Appl. No. 16/823,799 dated Jun. 26, 2020.
U.S. Patent and Trademark Office, Notice of Allowance issued in U.S. Appl. No. 16/823,799 dated Dec. 9, 2021.

* cited by examiner

REFRIGERATOR WITH A SLIDING SHELF

BACKGROUND

The present embodiments relate to a sliding shelf integrated into a refrigerator appliance.

Typical refrigerators have included conventional shelving. However, the conventional shelving may not accommodate large or tall items. Thus, there is a need for an intelligible sliding shelf and/or track to allow flexible positioning of one or more sliding shelves and/or tracks within a refrigerator.

SUMMARY

In some embodiments of the invention, for example, a refrigerator appliance comprising a housing, at least one door, a pair of tracks, and/or at least one sliding shelf. In various embodiments, the housing may define at least one compartment. In some embodiments, at least one door may be attached to the housing and may define at least a portion of at least one compartment. In various embodiments, the pair of tracks may be positioned within the housing. In addition, in some embodiments, at least one sliding shelf may be positionable within at least one compartment of the housing. In some embodiments, at least one sliding shelf may slide between a stowed position and a deployed position along the pair of tracks, and wherein the deployed position may be different from the stowed position. In various embodiments, at least one sliding shelf may include a plurality of shelf plates spaced for a distance from each other in a direction of sliding between the stowed position and the deployed position.

In some embodiments, at least one sliding shelf may include a plurality of links interconnecting the plurality of shelf plates to each of the pair of tracks, wherein two opposing links of the plurality of links on the respective pair of tracks receives an end of at least one of the plurality of shelf plates, respectively. In various embodiments, the refrigerator appliance may further comprise a plurality of biased locks fixing the position of at least one sliding shelf in at least the deployed position. In various embodiments, the plurality of shelf plates may be spaced from each other when in both the stowed position and the deployed position. In some embodiments, at least one sliding shelf may include a plurality of rollers to engage the pair of tracks, the plurality of rollers slide at least a portion of the at least one sliding shelf from a horizontal orientation in the deployed position to a vertical orientation when in the stowed position. Moreover, in some embodiments, the plurality of shelf plates may be spaced from each other for the distance by a gap extending for a length between opposing ends of at least one shelf plate of the plurality of shelf plates.

In various embodiments, a sliding shelf slidably engaging two tracks defining a path for the sliding shelf within a refrigerator appliance may comprise a first shelf plate, a second shelf plate, and/or a plurality of links. In some embodiments, the plurality of links may slidably engage the first shelf plate and the second shelf plate to the two tracks between a deployed position and a stowed position, wherein the deployed position is different from the stowed position. In various embodiments, the plurality of links may space the first shelf plate away from the second shelf plate for a distance to create a gap therebetween.

In addition, in some embodiments, a first link of the plurality of links may include a cradle receiving one end of the first shelf plate. In various embodiments, a second link of the plurality of links may include a cradle receiving an end of the second shelf plate. Moreover, in some embodiments, the sliding shelf of claim 9 may further include one or more shafts extending from one or more rollers, wherein each of the first link and the second link of the plurality of links may include a through opening receiving the one or more shafts. In various embodiments, the one or more shafts therein may allow the first shelf plate and the second shelf plate to pivot relative to each other. In some embodiments, the gap may extend along the first shelf plate for a length between opposing ends of the first shelf plate. In addition, in various embodiments, the plurality of links may include a through opening receiving a shaft therein allowing the first shelf plate and the second shelf plate to pivot relative to each other. In various embodiments, the sliding shelf may further include one or more locking mechanisms fixing the position of the sliding shelf relative to a pair of tracks. In some embodiments, the one or more locking mechanism may be a biased rocker arm positioned on a track of the pair of tracks to fix the position of the sliding shelf relative to the pair of tracks.

In various embodiments, a refrigerator appliance may include a housing, at least one door, one or more tracks, and/or at least one sliding shelf. In some embodiments, the housing may define at least one compartment. In various embodiments, at least one door may be attached to the housing and may define at least a portion of at least one compartment. In some embodiments, at least one pair of tracks may be positioned within the housing. In addition, in various embodiments, at least one sliding shelf may be positionable within at least one compartment of the housing, wherein the at least one sliding shelf may slide between a stowed position and a deployed position along the pair of tracks, and wherein the deployed position may be different from the stowed position. In various embodiments, at least one sliding shelf may include a first shelf plate and a second shelf plate spaced from each other by a plurality of links coupling at least one sliding shelf to at least one pair of tracks. In some embodiments, the first shelf plate, the second shelf plate, and/or the plurality of links may define a through opening extending through at least one sliding shelf.

In addition, in some embodiments, the through opening of at least one sliding shelf may include an outer periphery defined by the first shelf plate, followed by at least one first link of the plurality of links, followed by the second shelf plate, followed by at least one second link of the plurality of links, before returning back to the first shelf plate. In various embodiments, at least one sliding shelf may include a plurality of rollers slidably engaging at least one pair of tracks between the stowed position and the deployed position. In some embodiments, the refrigerator appliance may further include one or more locking mechanisms to fix the position of at least one sliding track. In various embodiments, each one of adjacent links of the plurality of links slidably engaging a track of the one or more tracks may include a cradle receiving an end of the first shelf plate and the second shelf plate, respectively. In addition, in some embodiments, the refrigerator appliance may further include two sliding shelves of the one or more sliding shelves slidably engaging one track of at least one pair of tracks.

In some embodiments, a refrigerator appliance may include a housing, at least one door, a first track, a second track, and/or at least one sliding shelf. In various embodiments, the housing may define at least one compartment. In some embodiments, at least one door may be attached to the housing and may define at least a portion of at least one compartment. In addition, in some embodiments, a first track and a second track may be positioned within the housing. In various embodiments, the first track may include a first portion and a second portion, and wherein the first portion of the first track is positionable between a first configuration with the second portion of the first track and a second configuration with the second portion, wherein the second configuration is different from the first configuration. Moreover, in some embodiments, at least one sliding shelf may be positionable within the at least one compartment of the housing. In some embodiments, when the first track is in the first configuration at least one sliding shelf slides between a stowed position and a deployed position along both the first portion and the second portion of the first track and the second track, and wherein the deployed position is different from the stowed position.

In addition, in various embodiments, when the first portion of the first track is in the second configuration at least one sliding shelf cannot slide between the stowed position and the deployed position. In some embodiments, when the first portion of the first track is in the second configuration at least one sliding shelf is in the stowed position with the second portion of the first track and the second track. In some embodiments, the refrigerator appliance may further include a slide mechanism to position the first portion of the first track between the first configuration and the second configuration. Moreover, in various embodiments, the refrigerator appliance may further include a pivot mechanism to position the first portion of the first track between the first configuration and the second configuration. In some embodiments, the refrigerator appliance may further include a locking mechanism securing the first portion of the first track to the second portion of the first track in the first configuration. In various embodiments, the first portion and the second portion of the first track may define a slide receiving slot for the at least one sliding shelf, wherein when the first portion of the first track is in the second configuration the slide receiving slot of the first portion of the first track is misaligned with the slide receiving slot of the second portion of the first track.

In various embodiments, a sliding shelf for a refrigerator appliance may include a first track of a pair of tracks having a slide receiving slot for a sliding shelf to travel between a stowed position and a deployed position. In some embodiments, the first track may have a first portion and a second portion each defining a portion of a length of the slide receiving slot. In various embodiments, the first portion of the first track may be displaced from the second portion of the first track when the sliding shelf is in the stowed position.

In addition, in some embodiments, the first portion of the first track may be displaceable from the second portion of the first track only when the sliding shelf is in the stowed position. In various embodiments, the sliding shelf may further include a locking mechanism, wherein the locking mechanism may fix the first portion of the first track with the second portion of the first track. In some embodiments, the first portion of first track may be displaced from the second portion of the first track by at least one of sliding and/or pivoting relative to the second portion. Moreover, in some embodiments, the first portion of first track may be displaced from the second portion of the first track by sliding away from the second portion. In various embodiments, the sliding shelf may further include a slide mechanism displacing the first portion of the first track away from the second portion of the first track. In some embodiments, the slide mechanism may include a roller and slide engagement allowing horizontal sliding movement of the first portion of the first track relative to the second portion of the first track. In various embodiments, the slide receiving slot of the first portion may orientate the sliding shelf horizontally in the deployed position and the slide receiving slot of the second portion may orientate the sliding shelf vertically in the stowed position.

In some embodiments, a refrigerator appliance may include a first track and/or a second track. In various embodiments, a first track and second track may slidably engage a first sliding shelf between a stowed position and a deployed position. In some embodiments, the first track may have a sliding track portion and a fixed track portion. Moreover, in some embodiments, the sliding track portion of the first track may be slid away from the fixed track portion of the first track when the first sliding shelf is in the stowed position.

In addition, in various embodiments, the sliding track portion of the first track may slide on a third track. In some embodiments, the sliding track portion may include one or more rollers adjacent a distal end thereof, wherein the one or more rollers slidably engage the third track. In various embodiments, the first track may include a locking mechanism releasably securing the sliding track portion with the fixed track portion at a first positon along the third track. In some embodiments, the first sliding shelf may engage the sliding track portion of the first track when in the deployed position and may disengage from the sliding track portion of the first track when in the stowed position. Moreover, in some embodiments, the refrigerator appliance may further include a second sliding shelf slidably engaging the first track.

These and other advantages and features, which characterize the embodiments, are set forth in the claims annexed hereto and form a further part hereof. However, for a better understanding of the embodiments, and of the advantages and objectives attained through its use, reference should be made to the Figures and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential refrigerator appliance such as refrigerator appliance 10, such as the type that may be used in single-family or multi-family dwellings, or in other similar applications. However, it will be appreciated that the herein-described techniques and apparatuses may also be used in connection with other types of refrigerator appliances in some embodiments. For example, the herein-described techniques may be used in commercial applications in some embodiments. Moreover, the herein-described techniques may be used in connection with various refrigerator appliance configurations. Implementation of the herein-described techniques within side-by-side refrigerators, bottom freezer refrigerators, top freezer refrigerators, french-door refrigerator, wine refrigerators and beverage centers, compact refrigerators, etc. would be well within the abilities of one of ordinary skill in the art having the benefit of the instant disclosure, so the embodiments are not limited to a refrigerator implementation discussed further herein.

Figure 1:
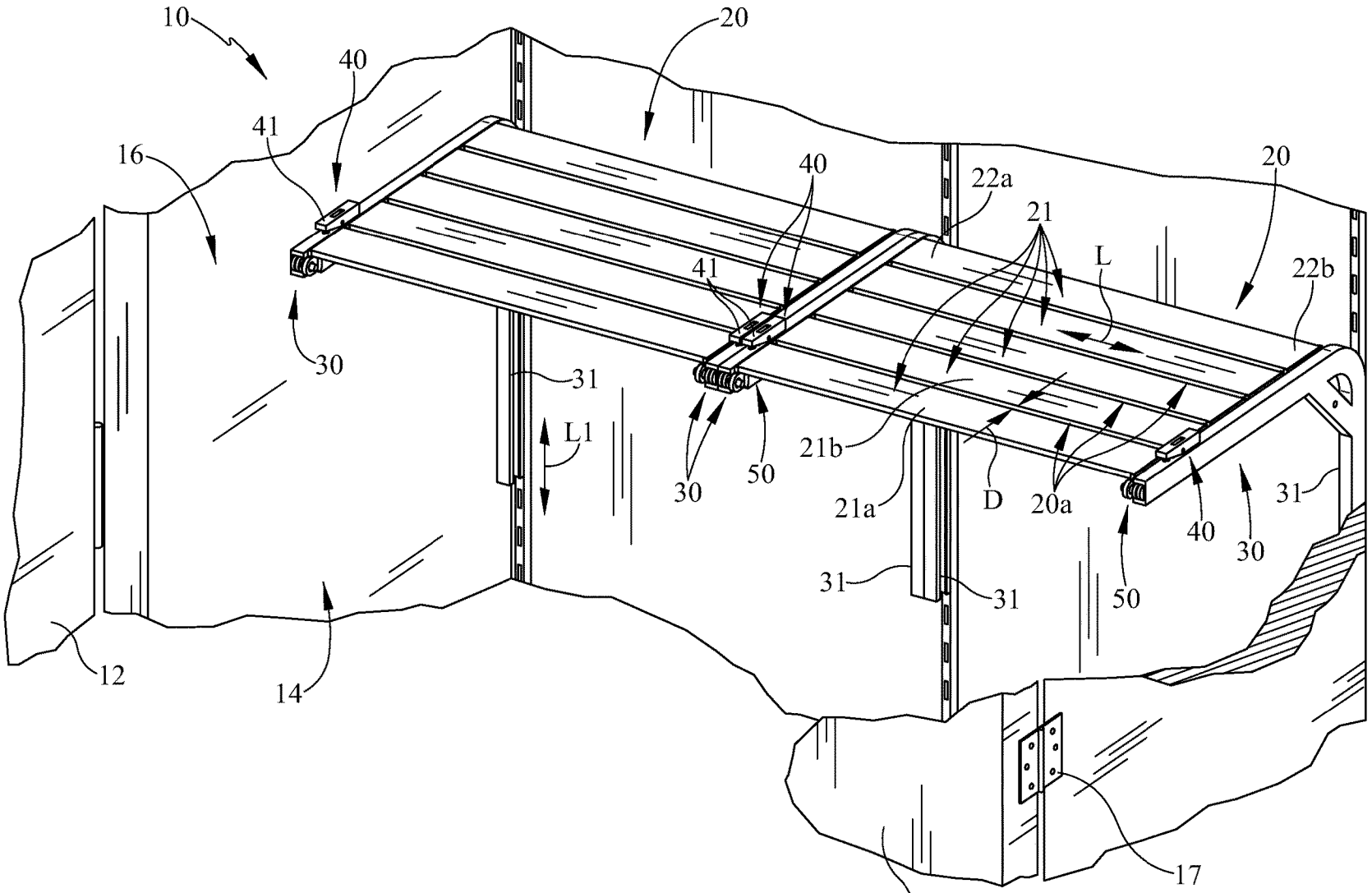
FIG. 1 is a perspective view of one embodiment of a sliding shelf, with portions of the refrigerator broken away.
Figure 2:
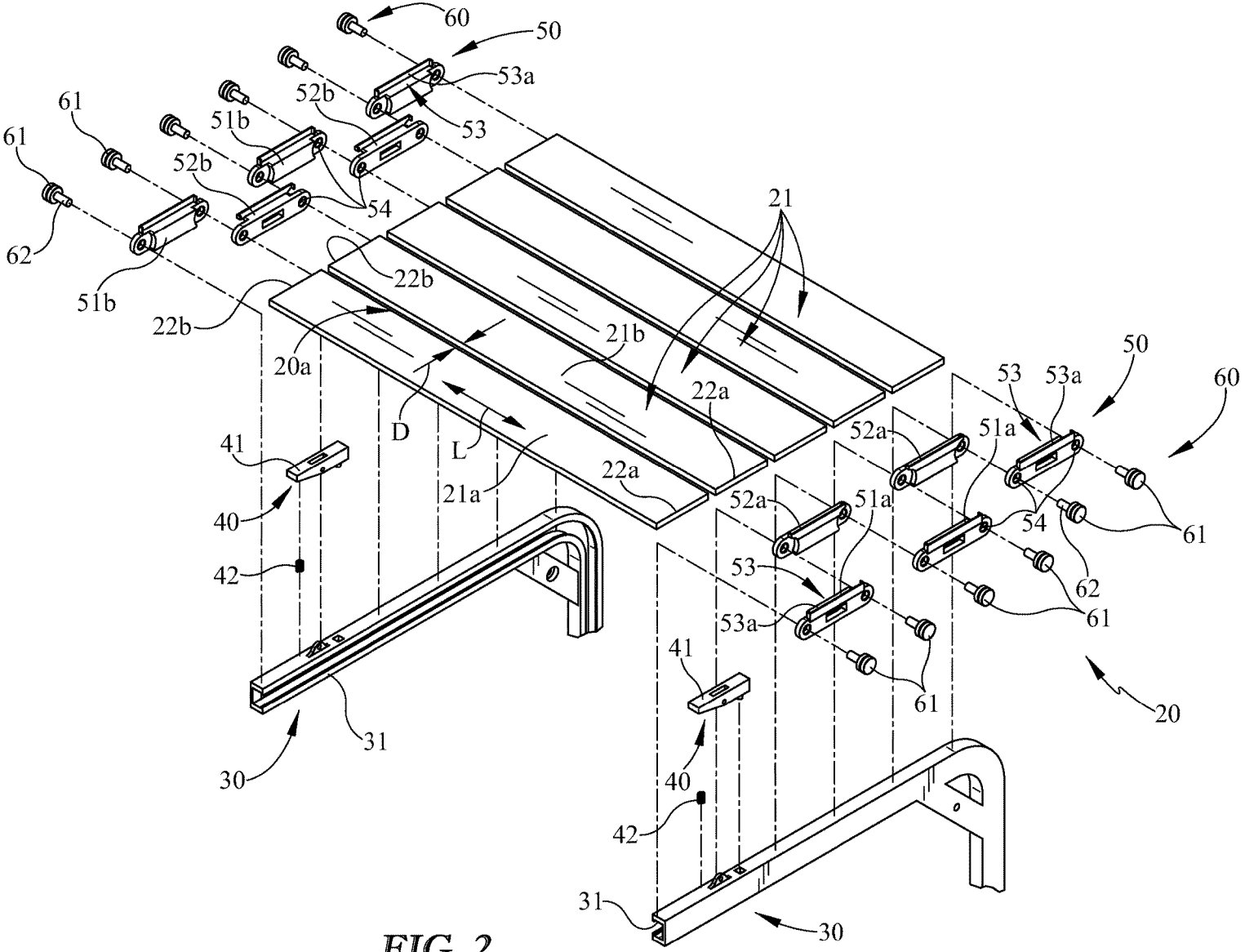
FIG. 2 is an exploded view of the sliding shelf of FIG. 1.

Turning now to the Figures, FIG. 1 illustrates an example refrigerator appliance 10 in which the various technologies and techniques described herein may be implemented. Although, the one or more sliding shelves 20 and/or one or more tracks 30, or portions thereof, may used in a variety of appliances other than refrigerators 10 (e.g. ovens, dish washing machines, freezers, etc.). Refrigerator appliance 10 is depicted in this example as a french door refrigerator, and as such includes front-mounted doors 12 in a cabinet or housing 14 that provides access to the freezer and/or fresh-food compartment 16 housed within the cabinet or housing 14. The housing 14 and/or door 12 may at least partially define the one or more compartments 16. Similarly an adjacent pivotable door 12 may provide access to the one or more compartments (e.g. same or different compartment) or portions thereof and when in the open position, food and beverage items may be inserted into and removed from the compartments 16. One or more doors 12 may be generally provided with a hinge 17 along a side or top edge of the housing 14 and/or compartment 16 and is pivotable between an open position and a closed position illustrated in FIG. 1, one door 12 is open and another door 12 is closed. When door 12 is in the open position, food and beverage items may be inserted into and removed from the compartment 16 and/or sliding shelf 20 through the door 12 or, alternatively, through an opening in the door 12. Moreover, the sliding shelves 20 and/or tracks 30, or portions thereof, may be moved or travel between desired positions (e.g. vertical, horizontal, etc.). Control over refrigerator appliance 10 by a user is generally managed through a control panel, which can be disposed on the door. It will be appreciated that in different appliance designs (e.g. refrigerator), the sliding shelves 20 and/or tracks 30 may be of a variety of shapes, sizes, quantities, positions within the appliance, and constructions and still be within the scope of the invention. For example, although the one embodiment of the sliding shelf 20 and/or track 30 is positioned in the fresh-food compartment 16, it should be understood that the one or more sliding shelves/racks may be used in a variety of compartments (e.g. freezer, etc.) or positions within an appliance (e.g. door). For example, the sliding shelf and/or track may be used in the other places besides the back wall of the compartment of an appliance for example within the fresh-food compartment and/or freezer compartment (e.g. one or more side walls), door, etc. Moreover, the sliding shelf 20 and/or track 30 may be used along with one or more fixed shelves/racks/bins, if used.

As shown in the Figures, a refrigerator appliance 10 may include one or more sliding shelves 20. Referring to FIGS. 1-8, the one or more sliding shelves 20 may be positioned and/or reconfigured within the housing 14/compartment 16 of the refrigerator to create a variety of spacing and/or patterns to maximize the available space (e.g. for large or tall items). As shown in the one embodiment, the sliding shelf 20 or portions thereof may move/travel/slide between a plurality of positions (e.g. stowed, deployed, etc.) along one or more rails/guides/tracks 30 in one or more directions (e.g. vertical, horizontal, and/or angled, etc.) for a variety of distances. The one or more sliding shelves 20 may slidably engage and may be moveable along the tracks 30 (e.g. one or more tracks, pairs of tracks, etc.) between one or more positions (e.g. vertical/horizontal positions, different elevations, different locations, etc.). As shown in the one embodiment, the one or more sliding shelves 20 may be orientated/moved/slid along the one or more tracks 30 between at least one stowed position (e.g. vertical orientation) and at least one deployed position (e.g. horizontal orientation). In some implementations, the shelf 20 may be selectively adjusted up and/or down with one or more actuators or locking mechanisms 40 (e.g. biased locks, actuators, rocker arm, etc.) releasably fixing or securing the sliding shelf in one or more positions (e.g. stowed and/or deployed position). The one or more locking mechanisms 40, if used, may releasably engage and/or disengage from the one or more tracks 30 allowing the relative movement of the one or more sliding shelves 20 along the length or portions thereof of the track 30. As shown, the locking mechanism 40 fixes or secures (e.g. releasably) one or more sliding shelves 20 in at least the deployed position, but may fix at a variety of sliding positions or increments along the track or tracks. It should be understood that one or more of the sliding shelves 20 may slide relative to one or more tracks. As shown, the sliding shelf 20 slides between two opposing or pairs of tracks 30. Moreover, in some embodiments, a single track 30, 130 (e.g. with two or more slide receiving slots) may slidably engage a plurality of sliding shelves. The sliding shelves 20 and/or tracks 30 may be positionable (e.g. up, down, laterally, one or more side walls, etc.) to a variety of locations within the compartment to have another deployed/stowed position in some embodiments. For example as shown, the sliding shelf 20 and/or track 30, 130 may move vertically or be removed from the compartment 16 or housing 14, or portions thereof (e.g. vertical hanger bars), to one or more additional vertical locations to be deployed/stowed. Moreover, for example, the tracks 30 may be directly mounted to or integrated with one or more walls of the compartment.

Figure 3:
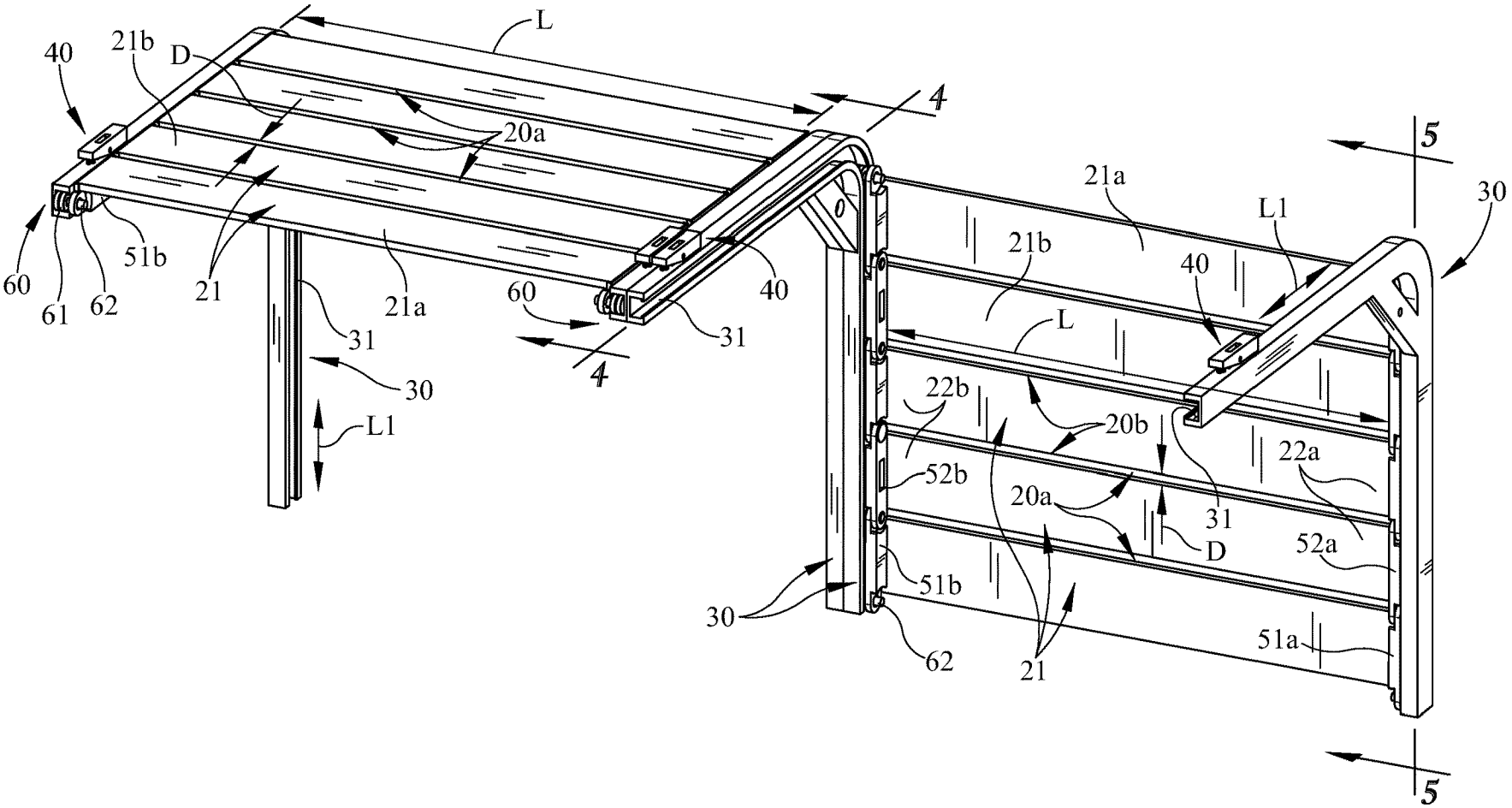
FIG. 3 is a top perspective view of the sliding shelf of FIG. 1, illustrating the sliding shelf in a stowed or vertical position and another sliding shelf in a deployed or horizontal position.
Figure 3A:
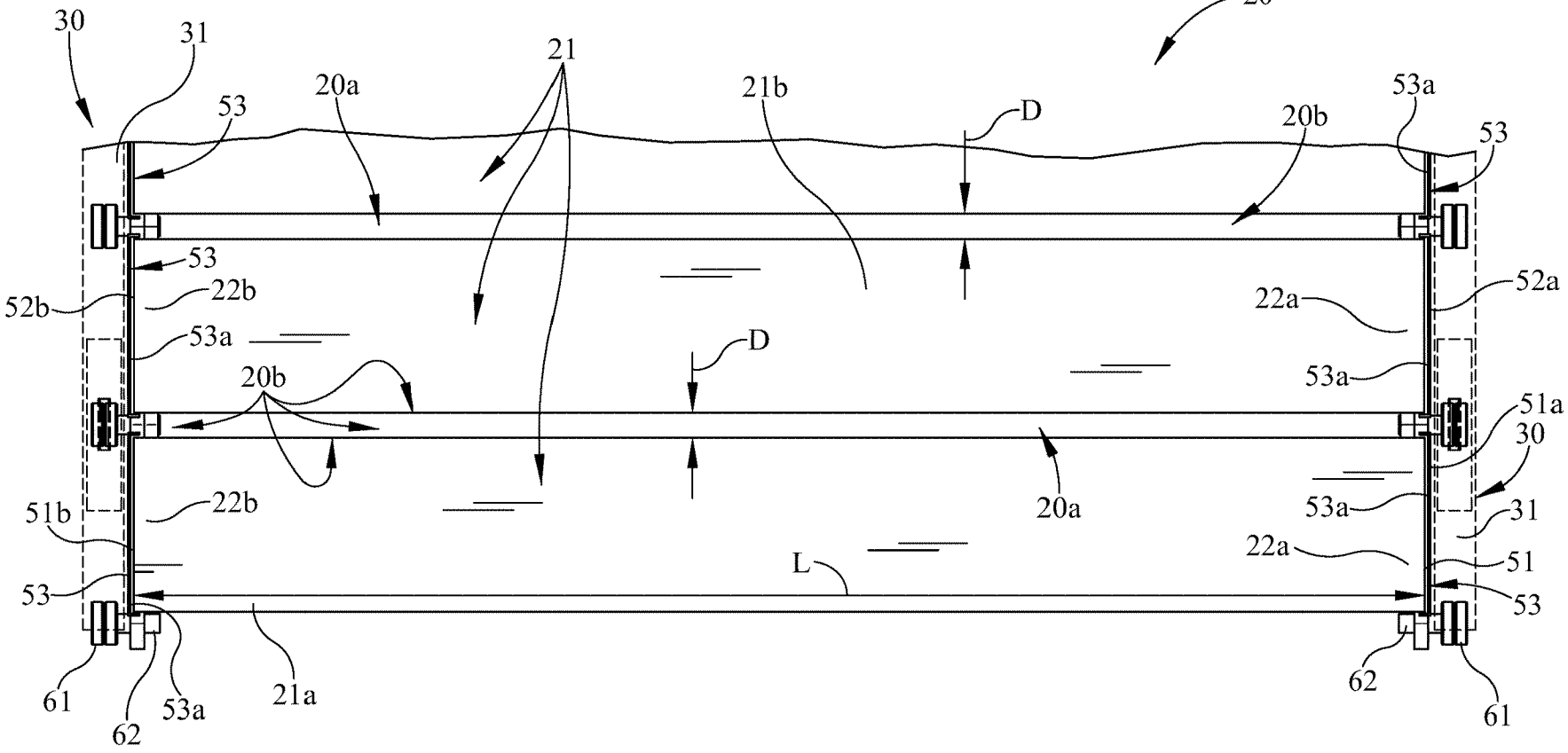
FIG. 3A is an enlarged view of the sliding shelf of FIG. 3.
Figure 4:
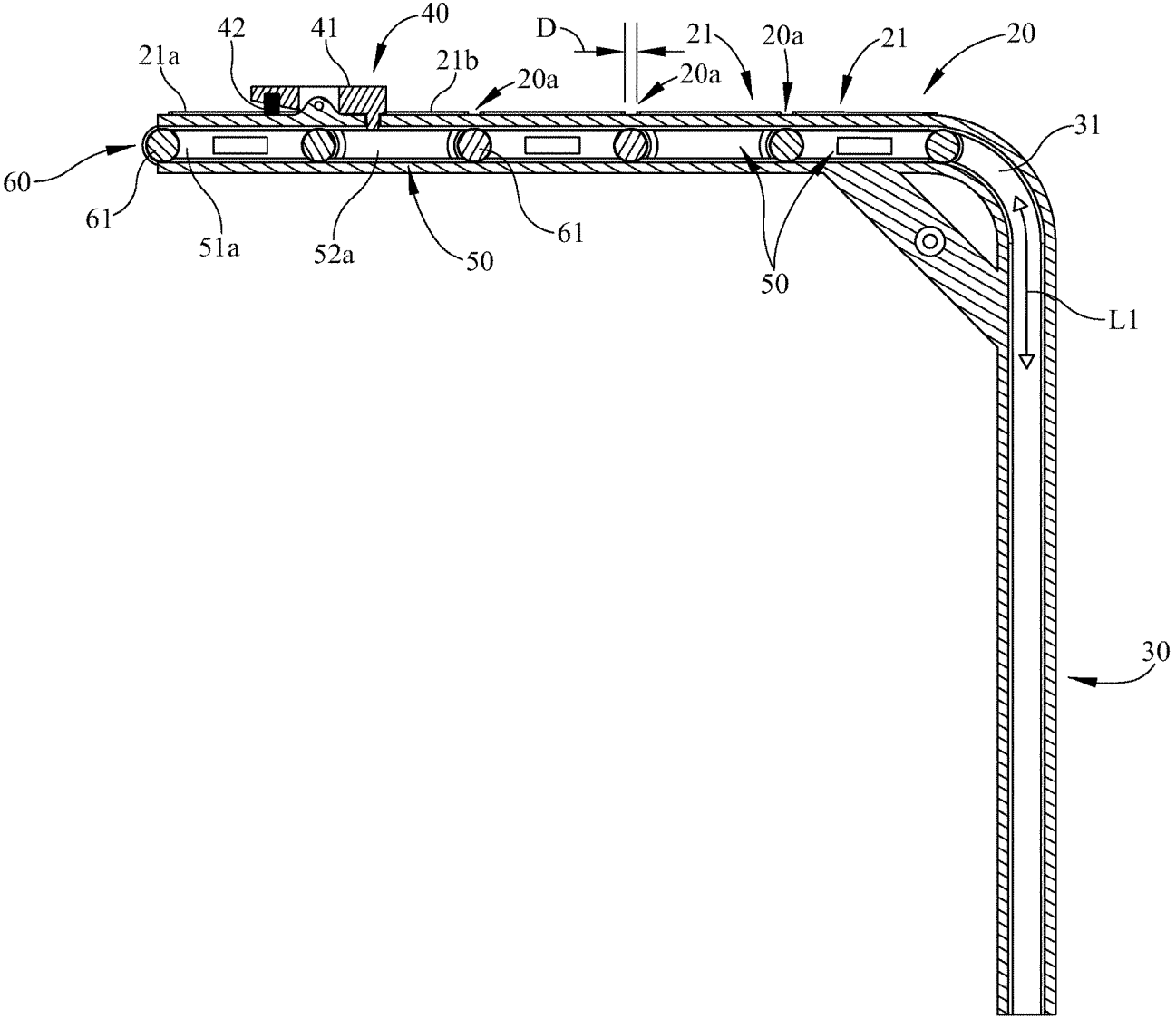
FIG. 4 is a sectional view of the embodiment of the sliding shelf of FIG. 3 taken along line 4-4, illustrating the sliding shelf in the deployed position and the locking mechanism releasably engaging or locking the position of the sliding shelf relative to the track.
Figure 5:
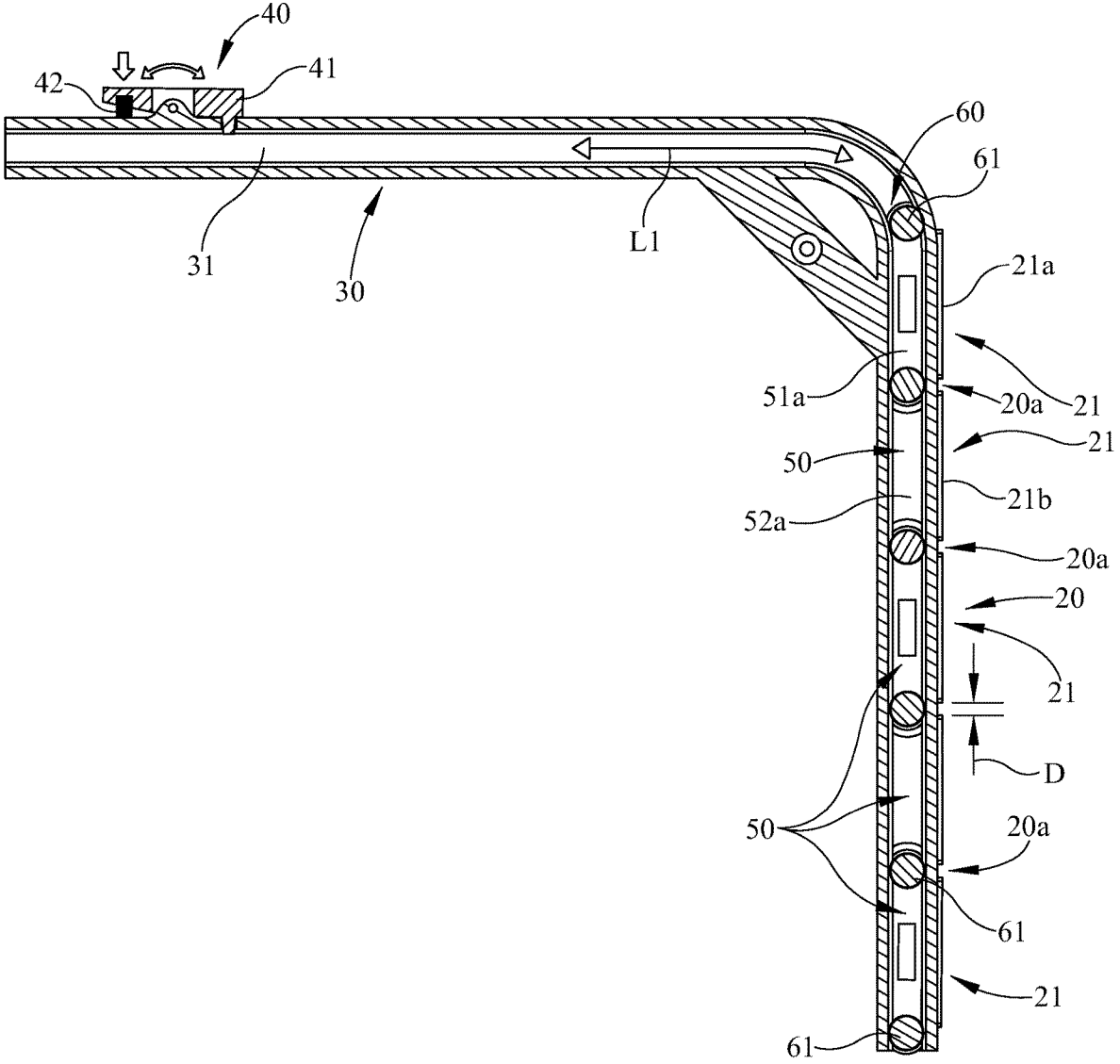
FIG. 5 is a sectional view of the embodiment of the sliding shelf of FIG. 3 taken along line 5-5, illustrating the sliding shelf in the stowed position and the locking mechanism disengaged from the sliding shelf.

In some implementations, the sliding shelf 20 may include a plurality of shelf plates 21. The shelf plates 21 may be elongated planar members (e.g. rectangular) as shown in the Figures. The shelf plates 21 may be made of material such as, but is not limited to, glass or other substantially transparent materials. Each shelf plate 21 may have opposing ends 22*a*, 22*b* adjacent the tracks 30 and/or links 50. The shelf plates 21 may be spaced or separated from each other by one or more gaps 20*a*. The spacing/through opening or gap 20*a* between adjacent plates 21 may be for a distance D in the direction of sliding (e.g. direction or length of track 30) between the stowed position and the deployed position. At least one pair of shelf plates 21 may have the gap 20*a* therebetween. The gap 20*a* may extend longitudinally or perpendicular to the distance D direction along adjacent edges of the shelf plates 21 or between opposing ends 22*a*, 22*b* for one or more lengths L. In some embodiments, the gap 20*a* (e.g. longitudinal and lateral gap) may be substantially the entire length L between the opposing ends 22*a*, 22*b* of the shelf plates. As shown in FIG. 3A, the shelf plates 21 may be spaced at a substantially continuous distance D and/or length L from each other when in both the stowed position and the deployed position. Moreover, the spacing of the gap 20*a* may be substantially continuous or maintained when traveling/sliding between positions along the one or more tracks 30. However, it should be understood that the gap 20*a* may vary in distance/length/shape/size/quantity between pairs of or adjacent shelf plates of the sliding shelf. Alternatively, the gap distance/length may vary (e.g. increase and/or decrease) while traveling or in different sliding positions along the tracks. For example, the gap length and/or distance may be zero in at least one sliding position. The shelf plates, or portions thereof, may be a variety of shapes, sizes, quantities, and construction and still be within the scope of the invention.

In some implementations, the sliding shelf 20 may have one or more links 50 interconnecting, coupling, slidably engaging the one or more shelf plates 21 (e.g. first shelf plate 21*a* and second shelf plate 21*b*) to the one or more tracks 30. In the one embodiment shown, the plurality of links 50, if used, may space the adjacent shelf plates 21 (e.g. first shelf plate 21*a* and second shelf plate 21*b*) away from each other by at least one gap 20*a*. Two opposing first links 51*a* and 51*b* adjacent their respective tracks 30 may receive the opposing ends 22*a*, 22*b* of at least one first shelf plate 21*a*. The next adjacent second shelf plate 21*b* may be received by the two adjacent opposing second links 52*a* and 52*b*. Although not shown, one or more links 50, without a shelf plate, may be positioned between two links 50 each containing the shelf plate, respectively. As shown in the Figures, one or more links 50 may include one or more couplings or cradles 53 receiving at least one end 22*a* or 22*b* of the shelf plate 21. In some embodiments as shown, the cradle 53 of one link 50 may include an open ended slot 53*a* facing inwardly away from the tracks 30 to receive the shelf plate end. The cradle 53 may receive and contact one or more surfaces or sides of the shelf plate. Although not shown, one or more fasteners may be used to secure the shelf plate to the one or more links. The links, or portions thereof, may be a variety of shapes, sizes, quantities, and construction and still be within the scope of the invention.

In some implementations, the gap 20*a* may be a variety of shapes, sizes, quantities, positons within the sliding shelf, and constructions and still space the shelf plates 21 away from each other. The one or more gaps 20*a* or spacing between shelf plates 21 or other portions of the sliding shelf may, but is not limited to, allow additional light to pass between (e.g. up and/or down) the shelf plates to aid the user, direct airflow (e.g. up and/or down), and/or increase (e.g. up and/or down) air flow therebetween. In some embodiments, the gap 20*a* may be described as or defined by a through opening extending through the sliding shelf. The through opening or gap 20*a* may be defined by a variety of structure of the sliding shelf 20. As shown in the one embodiment, the through opening 20*a* of the sliding shelf may be defined by one or more shelf plates 21, the first shelf plate 21*a*, second shelf plate 21*b*, one or more tracks 30, the one or more links 50, and/or other portions of the sliding shelf and/or appliance. For example, in the one embodiment shown in FIG. 3A, an outer periphery 20*b* of the through opening or gap 20*a* may be defined by the first shelf plate 21*a* (e.g. lateral edge and/or one or more surfaces), followed by at least one link 50 (e.g. the first link 51*a* at one end of the first shelf), followed by the second shelf plate 21*b* (e.g. lateral edge and/or one or more surfaces), followed by at least one link (e.g. the second link 51*b* at one end of the first shelf), before returning back to the first shelf plate 21*a*.

In some implementations, the sliding shelf 20, or portions thereof, may slide relative to the one or more tracks 30 by a variety of sliding mechanisms 60. In the one embodiment shown, the sliding shelf 20 may include a sliding mechanism/engagement 60 such as one or more rollers 61 slidably engaging the one or more tracks 30, or portions thereof (e.g. longitudinal slots, slide receiving slot, paths, channels, etc.). The one or more links 50 may be positioned between the rollers 61 and the shelf plates 21. A shaft or pin 62 may extend from the roller 61 and pass through and is received by one or more through openings 54 of the one or more adjacent links 50 (e.g. adjacent first links 51*a* and second links 52*a*). The shaft 62 may pass through the through opening 54 at one end of the first link 51*a* and continue through the through opening 54 at one end of the second link 52*a*. The one or more shafts 62 extending from the rollers 61, or alternatively other shafts without rollers, may be received by one or more through openings 54 of the plurality of links to pivotally connect the links 50 (e.g. first and second links) and/or shelf plates 21 (e.g. first and second shelf plates) relative to each other when sliding between the one or more sliding positions (e.g. stowed and deployed positions). The sliding engagement, or portions thereof, may be a variety of shapes, sizes, quantities, and construction and still be within the scope of the invention. For example, although not shown, the sliding mechanism may be a rack and gear mechanism. Moreover, in some embodiments, the sliding mechanism or sliding shelf may include a spring/damper mechanism to assist sliding (e.g. stopping, movement, speed, etc.). In addition, in various embodiments, the sliding shelf and/or sliding mechanism may be manual, as shown, and/or motorized.

In some implementations, the one or more tracks 30 or pair of tracks 30 may define a path for the sliding shelf 20 within the refrigerator or appliance 10. It should be understood, that the one or more tracks 30 may be a variety of shapes, sizes, quantities, positions within the appliance, and constructions and still allow for the sliding of the shelf. As shown in the one embodiment, the track 30 may include at least one slide receiving slot 31. The slide receiving slot 31 may extend in the direction of travel of the sliding shelf 20 between the stowed and deployed positions. The slide receiving slot 31 slidably engages the sliding shelf 20, or portions thereof (e.g. rollers 61). The slide receiving slot 31 of one track 30 may face towards another slide receiving slot 31 of an adjacent track 30 (e.g. a pair of tracks). In some embodiments, the track may include two or more slide receiving slots 31 or allow sliding of more than one shelf. Moreover, the pair of tracks or track 30 may be L-shaped and extend vertically along a wall (e.g. rear, side, etc.) of the compartment 16 and project out into the compartment horizontally. The horizontal and vertical portions of the track 30 may be connected by a curved or arcuate portion. The length L1 of the slide receiving slot 31 may be a variety of lengths extending along one or more portions of the track. The sliding shelf may slide or rollaway to the rear wall of the compartment 16 in some embodiments.

It should be understood that the locking mechanism 40, if used, may be a variety of shapes, sizes, quantities, and constructions and still allow the sliding shelf 20 to be fixed or releasably secured in one or more positons along the one or more tracks 30 or slide receiving slot 31 (e.g. length L1). The incremental lockable positions along the track or tracks 30 may define the useable surface area of the sliding shelf 20 or shelf plates 21. As shown in the one embodiment, the one or more locking mechanisms 40, if used, may be an actuated or biased lock or rocker arm 41. The locking mechanism 40 may be a rocker arm 41 positioned on the one or more tracks 30 to engage or disengage the sliding shelf 20, or portions thereof (e.g. one or more links 50, shelf plates 21, rollers 61, shafts 62, etc.) to fix the position of the sliding shelf 20 relative to the tracks or other appliance structure. Although the locking mechanism 40 is shown on one side (e.g. top) of the track 30, it should be understood that the locking mechanism may be in a variety of positions of the track. For example, on the bottom side of one of more tracks. The rocker arm 41 may be urged/pivoted by the spring mechanism 42 into the slide receiving slot 31 towards or into engagement with the sliding shelf 20 (e.g. roller, link, shaft, pin, plate, etc.). The locking mechanism 40 or rocker arm 41 may engage the sliding shelf until actuated by the user to release the sliding shelf 20 (e.g. pivoted out of interference within the slide receiving slot or shelf) to allow movement to another or different position along the track. Moreover, although not shown, other portions (e.g. shelf, shelf plates, linkages, etc.) of the sliding shelf besides the track may include the locking mechanism. For example, a handle, if used, may include the locking mechanism.

Figure 6:
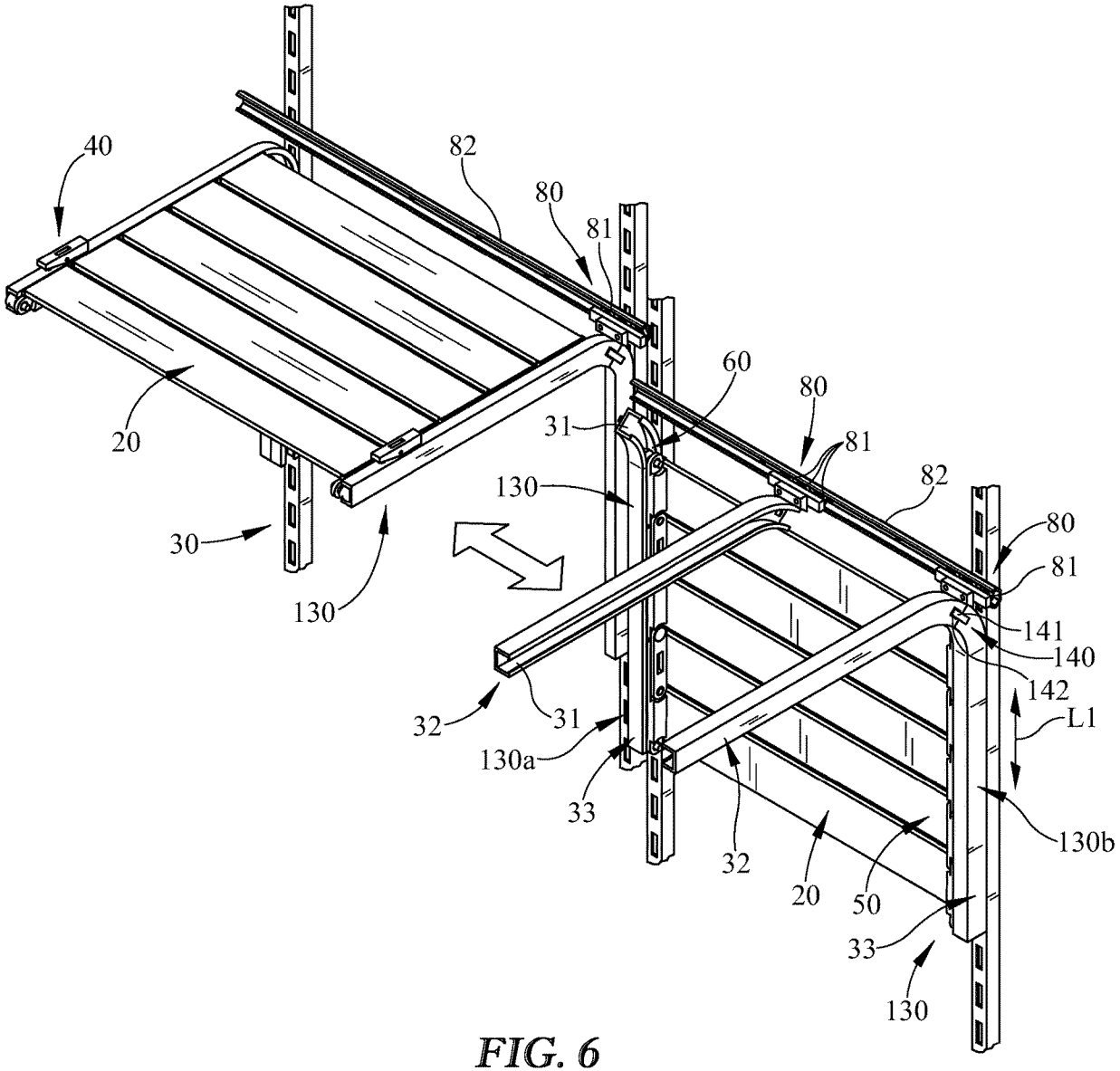
FIG. 6 is a perspective view of the sliding shelf of FIG. 1 with another embodiment of a track, illustrating a reconfigurable track or portions thereof.
Figure 7:
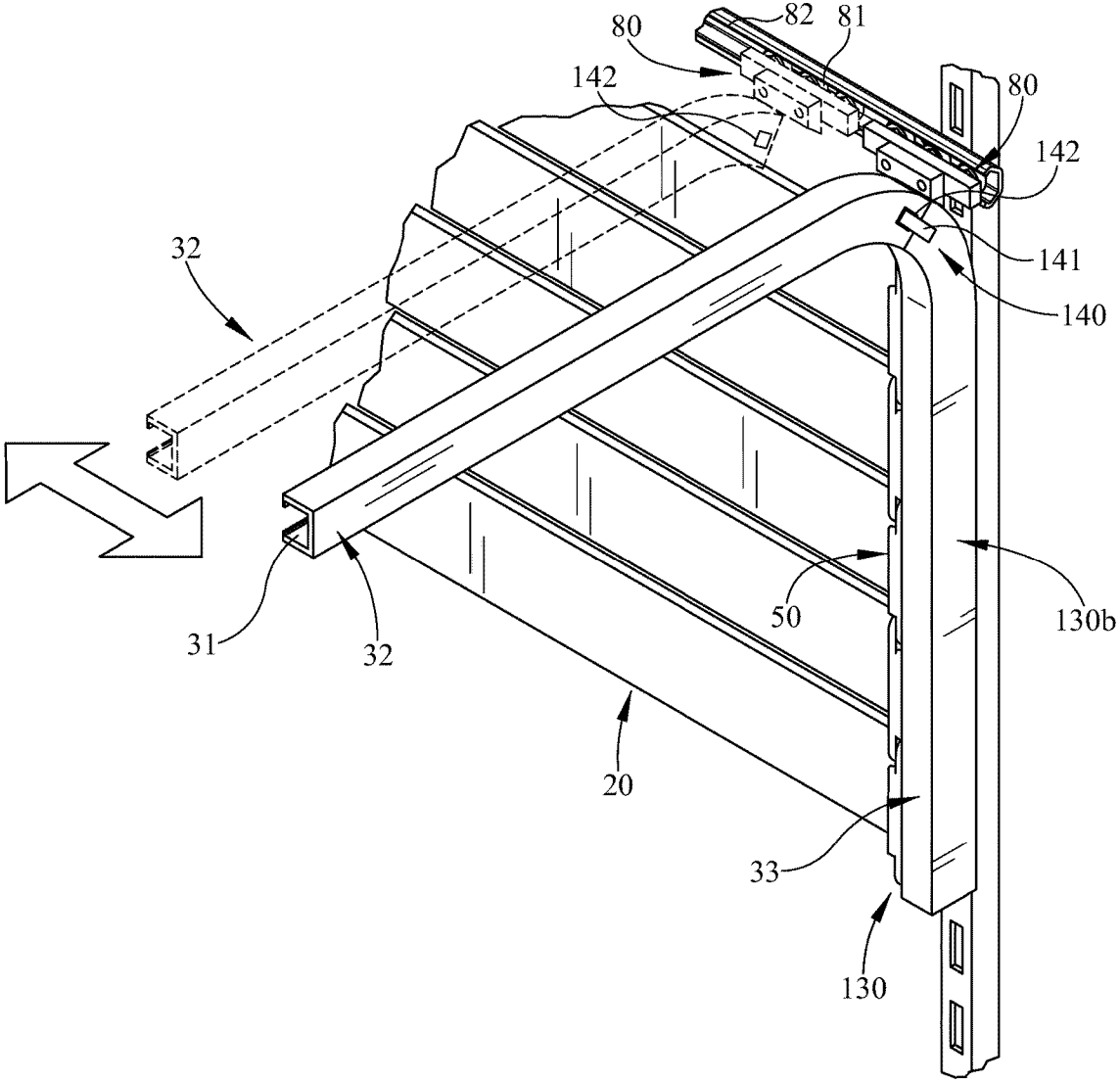
FIG. 7 is an enlarged perspective view of the track of FIG. 6, illustrating the reconfigurable track together in a first configuration and a portion of the reconfigurable track shown in broken lines in a second configuration by sliding away from the first configuration.
Figure 8:
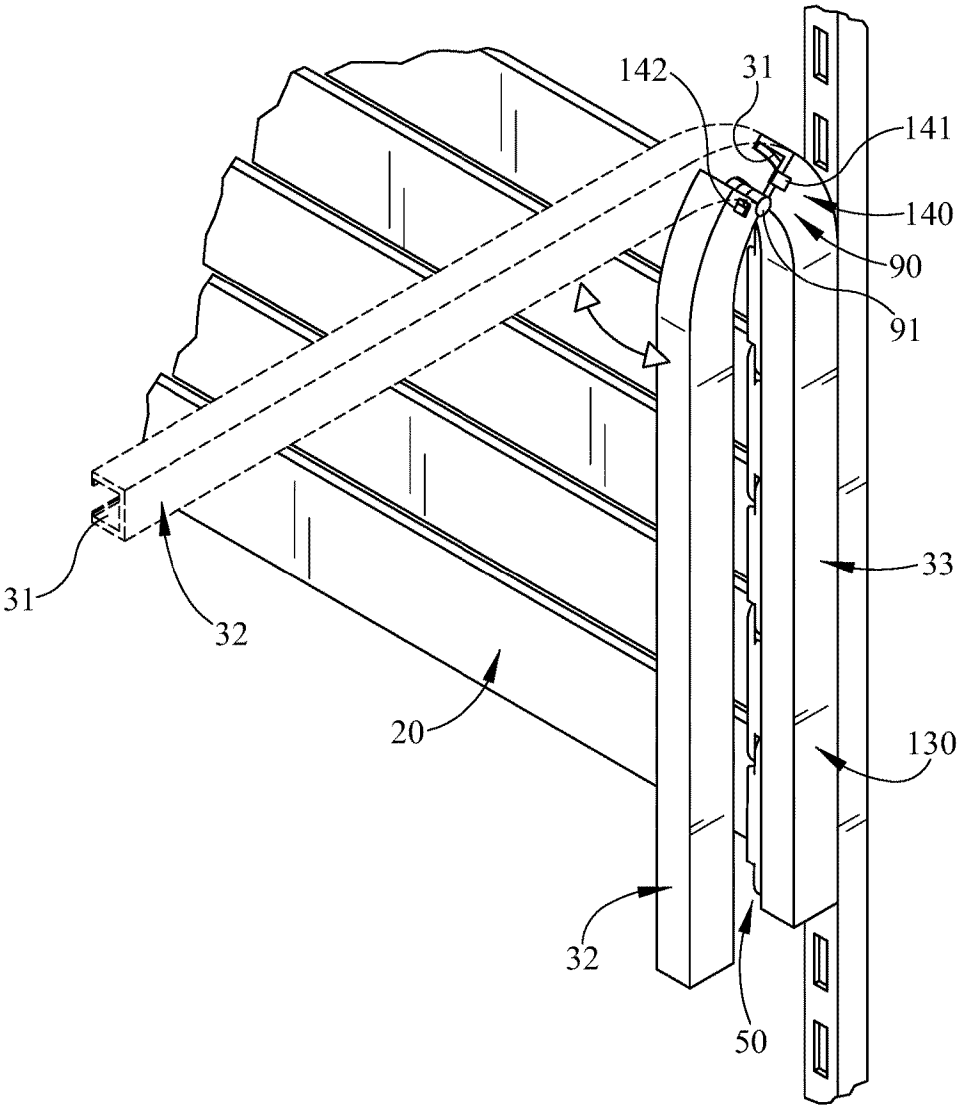
FIG. 8 is a perspective view of another embodiment of a track, illustrating the reconfigurable track, or portions thereof, in a second configuration by pivoting away from the first configuration shown in broken lines.

In some implementations, one or more tracks or portions thereof may be repositionable or flexible positionable to accommodate larger items and/or vary available space within the compartment. Although the embodiment of the track 30 as shown in FIGS. 1-5 may be a single piece that may not be adjustable when attached in at least one position within the compartment of the housing, another embodiment of one or more tracks or track system 130 as shown in FIGS. 6-8 may allow for adjustability within the appliance. The tracks 30, 130 may be made of one or more materials. The one or more tracks may be made of two materials in some embodiments. For example, one track may be a metal support/rail with a plastic channel defining the slide receiving slot 31.

In some implementations, one or more portions of at least one track 130 may be repositionable or displaceable relative to another or more portions of the at least one track 130. As shown in FIGS. 6-8, a first track 130*a* may include at least a first, moving, or sliding track portion 32 and a second or fixed track portion 33. The first portion 32 and the second portion 33 may each define a portion of the length L1 of the slide receiving slot 31 or track 130. The track 130 (e.g. first track 130*a* and second track 130*b*) may be postionable between a first configuration (see second track 130*b* in FIG. 6) and a second configuration (see first track 130*a* in FIG. 6). For example, the first portion 32 of the second track 130*b* may be postionable or slide between the first configuration (shown as solid lines in FIG. 7) and second configuration (shown as broken lines in FIG. 7) relative to the second portion 33 of the second track 130*b*. The first configuration is different than the second configuration.

In various embodiments when the track 130 or first portion 32 is in the first configuration, the sliding shelf 20 may be able to slide or operate between one or more positons (e.g. the stowed positon and the deployed position) along both the first portion and the second portion of the first track. In the first configuration, the slide receiving slot 31 and/or other structure of each one of the first portion 32 and second portion 33 of the first track 130*a* may be aligned and/or operable to allow sliding of the shelf. Moreover in the first configuration, the rollers 61 are able to slide through the slide receiving slots 31 of both the first and second portions 32, 33 to one or more sliding positions. Conversely, in some embodiments as shown in the one embodiment in FIG. 6, the sliding shelf 20 may not be able to slide or cannot slide between one or more positons (e.g. the stowed and deployed position) or the portions thereof (e.g. first and/or second portions 32, 33) when the track 130 or first portion 32 is in the second configuration. In the second configuration, the slide receiving slot 31 and/or other structure of each one of the first portion 32 and second portion 33 of the first track 130*a* may be misaligned and/or inoperable to allow sliding of the shelf. Moreover in the second configuration, the rollers 61 may not be able to slide through the slide receiving slots 31 of at least the first portion 32 or both the first and second portions 32, 33 to one or more sliding positions. As shown in FIGS. 6, 7, and 8, the first portion 32 of the first track 130*a* and/or second track 130*b* may be able to move (e.g. displaced from the second portion 33) between the first and second configurations when the sliding shelf 20 is in at least one positon (e.g. the stowed position, adjacent to the compartment wall (e.g. rear, side, etc.), and/or stowed within the second portion of the track). Moreover, as shown in FIGS. 6 and 7, the first portion 32 may be, or may only be, able to slide or move when the sliding shelf 20 is in the stowed position. In some embodiments, the first portion 32 of the track 130 may be engaged with the sliding shelf 20 in the first configuration and may be disengaged from the sliding shelf 20 in the second configuration.

In some implementations, a variety of methods or structure may allow the track 130 (e.g. first portion 32 and/or second portion 33) to reconfigure between the first configuration and the second configuration. The track 130, or one or more portions thereof (e.g. first portion 32 and/or second portion 33), may move between a variety of locations and/or in a variety of directions when reconfiguring to the second configuration away from the first configuration. For example, the track 130, or portions thereof (e.g. first portion) may slide, pivot, rotate, translate, and/or separate from another one or more portions (e.g. second portion) of the track. Although not shown, a ball-joint may be used in some embodiments to reconfigure the track portions. Another example may be the first portion 32 of the track 130 is removed or disconnected from the second portion 33 or track system and stored in another location. Moreover, the first portion 32 or track portions may move up, down, left, right, horizontal, vertical, counter clockwise, clockwise, etc. relative to its first configuration, the second portion, or another one or more portions of the track or appliance.

In some implementations, the one or more tracks 130 or first portions 32 may slide between configurations (e.g. first and/or second configurations). As shown in the one embodiment in FIGS. 6 and 7, the track 130 may include a slide mechanism 80. The slide mechanism 80 may displace or slide the first portion 32 of the track 130 away from and/or towards the second portion 33. The slide mechanism 80 may include the first portion 32 of the track 130 sliding along the length of a third track, hanger, or track 82. The hanger 82 may be horizontally positioned. The slide mechanism 80, if used, may include a one or more rollers 81 slidably engaging the hanger or third track 82 (e.g. slide receiving slot, channel, etc.) and allow horizontal sliding movement of the first portion 32 of the track 130 relative to the second portion 33 of the track 130. The one or more rollers 81 may be adjacent the distal end of the first portion of the track or the engagement with the second portion 33 (e.g. curved portion). Although the hanger 82 or slide mechanism 80 is shown attached adjacent to the rear compartment wall, other positons and/or orientations should be understood to be within the scope of the invention. The slide mechanism 80, or portions thereof, may be a variety of shapes, sizes, quantities, and construction and still be within the scope of the invention. For example, in various embodiments, the sliding shelf and/or slide mechanism may be manual, as shown, and/or motorized. Moreover, in some embodiments, the slide mechanism may include a spring/damper mechanism to assist sliding (e.g. stopping, movement, speed, etc.).

In some implementations, the one or more tracks 130 or first portions 32 may pivot between configurations (e.g. first and/or second configurations). As shown in the one embodiment in FIG. 8, the track 130 may include a pivot mechanism 90. The pivot mechanism 90 may displace or pivot the first portion 32 of the track 130 away from or towards the second portion 33. The pivot mechanism 90, if used, may include the first portion 32 of the track 130 pivoting relative to the second portion 33. As shown in FIG. 8, the pivot mechanism 90 may include a one or more hinges 91 between one or more portions of the track 130 (e.g. first and second portions) and/or other portions of the appliance. The one or more hinges 91 may be positioned between the first portion 32 and the second portion 33. Although the hinge 91 may pivot the first portion 32 upwardly/downwardly as shown in FIG. 8, the first portion 32 may hinge in a variety of directions and/or positions relative to the second portion 33. For example, the first portion may hinge/twist left, right, etc. The pivot mechanism 90, or portions thereof, may be a variety of shapes, sizes, quantities, and construction and still be within the scope of the invention.

In some implementations, the one or more tracks may include one or more locking and/or stopping mechanisms 140. The locking mechanism may secure or fix one or more portions of the track 130 in one or more configurations. The locking mechanism 140 may secure the first portion 32 of the track 130 in a variety of positions (e.g. first and/or second configurations) relative to the second portion 33 of the track 130. The locking mechanism 140, if used, may releasably secure the first or sliding track portion 32 in at least one positon along the length of the third track 82/sliding mechanism 80. For example, as shown in FIGS. 6, 7, and 8, the locking mechanism 140 secures the track, or portions thereof, in at least the first configuration. The one or more locking mechanisms 140, if used, may releasably engage and/or disengage from the one or more track portions from each other allowing the relative movement of the one or more track portions (e.g. first portion) from another one or more track portions (e.g. second portion). As shown, the locking mechanism 140 fixes or secures (e.g. releasably) one or more first portions 32 in at least the first configuration with the second portion 33, but may fix the first portion at a variety of positions or increments (e.g. sliding, pivoting, second/deployed configurations, and/or other positions) when not in the first configuration. As shown in the one embodiment in FIG. 7, the locking mechanism 140 may be a catch 141 and receiving notch 142 engagement between the first and second portions 32, 33 of the track. It should be understood that the locking mechanism 140, if used, may be a variety of shapes, sizes, quantities, and constructions and still allow the one or more portions of the track to be releasably secured in one or more configurations. For example, the locking mechanism may be in other positions other than the track 130 (e.g. first portion and/or second portion) such as located on the hanger 82, or portions of the slide engagement 80, at different length increments.

It should be understood, that one or more portions of one track 130 or a plurality of tracks 130 of the sliding shelf 20 may be reconfigurable between two or more configurations. For example, both tracks 130 of a pair of tracks 130 slidably engaging the sliding shelf 20 may include the first portion 32 and second portion 33. In other embodiments, one track 130 of a pair of tracks (e.g. 30 and 130) may include the first portion 32 and second portion 33. Moreover, in some embodiments, a single track 130 (e.g. with two slide receiving slots) slidably engaging one or more sliding shelves 20 may include the first portion 32 and second portion 33. For example, the single track 130 that is shared by the two sliding shelves may be repositioned to the second configuration when both the sliding shelves are in the stowed position. The single track may slide laterally (e.g. left or right to one or more second configurations/positions). It should be understood, that a variety of sliding shelf embodiments, other than the sliding shelf 20 shown in the Figures, may be used with the one or more tracks 30, 130 and still be within the scope of the invention.

In use, to displace the first portion 32 of the track 130 from the second portion 33, when the sliding shelf 20 is deployed, the user may slide the sliding shelf 20 out of the deployed position or engagement with the first portion 32 of the track to the stowed position and/or engagement with the second portion 33 of track. A locking mechanism 40, if used, may be actuated to release the sliding shelf towards the stowed position. With the sliding shelf 20 in the stowed position, the user may release the locking mechanism 140, if used, and displace/slide the first portion 32 away from the second portion 33 or first configuration to one or more desired/second configurations. In some embodiments, if the locking mechanism is used, the first portion may be fixed in the desired second configuration. Moreover, if the user wants to redeploy the sliding shelf 20, the user may return the first portion 32 back to the first configuration with the second portion 33. This aligns the track 130, or one or more portions thereof (e.g. one or more slide receiving slots), for the one or more sliding shelves 20 to deploy to one or more deployed positions.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A refrigerator appliance comprising:

a housing defining at least one compartment;

at least one door attached to the housing and defining at least a portion of the at least one compartment;

a pair of tracks positioned within the housing;

at least one sliding shelf positionable within the at least one compartment of the housing, wherein the at least one sliding shelf includes a top surface and a bottom surface, wherein the at least one sliding shelf slides between a stowed position and a deployed position along the pair of tracks, and wherein the deployed position is different from the stowed position;

the at least one sliding shelf includes a plurality of shelf plates spaced for a distance from each other in a direction of sliding between the stowed position and the deployed position wherein the at least one sliding shelf includes a plurality of links interconnecting the plurality of shelf plates to each of the pair of tracks, wherein two opposing links of the plurality of links on the respective pair of tracks receives an end of at least one of the plurality of shelf plates, respectively; and a through opening extending from the bottom surface to the top surface of the at least one sliding shelf, wherein the through opening of the at least one sliding shelf includes an outer periphery defined by a first shelf plate of the plurality of shelf plates, followed by at least one first link of the plurality of links, followed by a second shelf plate of the plurality of shelf plates, followed by at least one second link of the plurality of links, before returning back to the first shelf plate.

2. The refrigerator appliance of claim 1 further comprising a plurality of biased locks fixing the position of the at least one sliding shelf in at least the deployed position.

3. The refrigerator appliance of claim 1 wherein the plurality of shelf plates are spaced from each other when in both the stowed position and the deployed position.

4. The refrigerator appliance of claim 1 wherein the at least one sliding shelf includes a plurality of rollers to engage the pair of tracks, the plurality of rollers slide at least a portion of the at least one sliding shelf from a horizontal orientation in the deployed position to a vertical orientation when in the stowed position.

5. The refrigerator appliance of claim 1 wherein the plurality of shelf plates are spaced from each other for the distance for an entire length between the two opposing links.

6. A sliding shelf slidably engaging two tracks defining a path for the sliding shelf within a refrigerator appliance comprising:

a first shelf plate;

a second shelf plate;

a plurality of links slidably engaging the first shelf plate and the second shelf plate to the two tracks between a deployed position and a stowed position, wherein the deployed position is different from the stowed position; and the plurality of links space the first shelf plate away from the second shelf plate for a distance to create a through opening, wherein an outer periphery of the through opening is defined by a lateral edge of the plurality of links, a lateral edge of the first shelf plate, and a lateral edge of the second shelf plate.

7. The sliding shelf of claim 6 wherein a first link of the plurality of links includes a cradle receiving one end of the first shelf plate.

8. The sliding shelf of claim 7 wherein a second link of the plurality of links includes a cradle receiving an end of the second shelf plate.

9. The sliding shelf of claim 8 further comprising one or more shafts extending from one or more rollers, wherein each of the first link and the second link of the plurality of links includes a through opening receiving the one or more shafts.

10. The sliding shelf of claim 9 wherein the one or more shafts therein allowing the first shelf plate and the second shelf plate to pivot relative to each other.

11. The sliding shelf of claim 6 wherein the through opening extends along the first shelf plate for an entire length between the plurality of links spacing the first shelf plate away from the second shelf.

12. The sliding shelf of claim 6 wherein the plurality of links include a through opening receiving a shaft therein allowing the first shelf plate and the second shelf plate to pivot relative to each other.

13. The sliding shelf of claim 6 further comprising one or more locking mechanisms fixing the position of the sliding shelf relative to a pair of tracks.

14. The sliding shelf of claim 13 wherein the one or more locking mechanisms is a biased rocker arm positioned on a track of the pair of tracks to fix the position of the sliding shelf relative to the pair of tracks.

15. A refrigerator appliance comprising:

a housing defining at least one compartment;

at least one door attached to the housing and defining at least a portion of the at least one compartment;

at least one pair of tracks positioned within the housing;

at least one sliding shelf positionable within the at least one compartment of the housing, wherein the at least one sliding shelf includes a top surface and a bottom surface, wherein the at least one sliding shelf slides between a stowed position and a deployed position along the pair of tracks, and wherein the deployed position is different from the stowed position;

the at least one sliding shelf includes a first shelf plate and a second shelf plate spaced from each other by a plurality of links coupling the at least one sliding shelf to the at least one pair of tracks;

the first shelf plate, the second shelf plate, and the plurality of links define a through opening extending from the bottom surface to the top surface of the at least one sliding shelf.

16. The refrigerator appliance of claim 15 wherein the through opening of the at least one sliding shelf includes an outer periphery defined by the first shelf plate, followed by at least one first link of the plurality of links, followed by the second shelf plate, followed by at least one second link of the plurality of links, before returning back to the first shelf plate.

17. The refrigerator appliance of claim 15 wherein the at least one sliding shelf includes a plurality of rollers slidably engaging the at least one pair of tracks between the stowed position and the deployed position.

18. The refrigerator appliance of claim 15 further comprising one or more locking mechanisms to fix the position of the at least one sliding track.

19. The refrigerator appliance of claim 15 wherein each one of adjacent links of the plurality of links slidably engaging a track of the at least one track include a cradle receiving an end of the first shelf plate and the second shelf plate, respectively.

20. The refrigerator appliance of claim 15 further comprising two sliding shelves of the at least one sidling shelf slidably engaging one track of the at least one pair of tracks.

* * * * *